US005701622A

United States Patent [19]

Biggie et al.

[11] Patent Number: 5,701,622

[45] Date of Patent: Dec. 30, 1997

[54] PULSATING OPERATING TABLE CUSHION

[75] Inventors: John Biggie; Lydia B. Biggie, both of Lighthouse Point, Fla.

[73] Assignee: Sentech Medical Systems, Inc., Fort Lauderdale, Fla.

[21] Appl. No.: 586,997

[22] Filed: Jan. 16, 1996

[51] Int. Cl.[6] ..... A61G 7/04; A61G 13/00

[52] U.S. Cl. ..... 5/713; 5/710; 5/81.1 T

[58] Field of Search ..... 5/903, 933, 710, 5/713, 715, 691, 711, 81.1 T

[56] References Cited

U.S. PATENT DOCUMENTS

| | | | |
|---|---|---|---|
| Re. 35,299 | 7/1996 | Weedling | 5/81.1 T |
| 1,772,310 | 8/1930 | Hart | 5/933 X |
| 3,199,124 | 8/1965 | Grant | 5/691 X |
| 3,297,023 | 1/1967 | Foley . | |
| 3,390,674 | 7/1968 | Jones . | |
| 3,394,415 | 7/1968 | Parker . | |
| 3,678,520 | 7/1972 | Evans | 5/713 |
| 3,867,732 | 2/1975 | Morrell . | |
| 4,267,611 | 5/1981 | Agulnick | 5/903 X |
| 4,653,130 | 3/1987 | Senoue et al. | 5/453 |
| 4,944,060 | 7/1990 | Peery et al. . | |
| 5,010,608 | 4/1991 | Barnett et al. | 5/453 |
| 5,092,007 | 3/1992 | Hasty | 5/691 X |
| 5,103,517 | 4/1992 | Krouskop | 5/450 |
| 5,103,518 | 4/1992 | Gilroy et al. | 5/713 |
| 5,103,519 | 4/1992 | Hasty . | |
| 5,109,561 | 5/1992 | Schild | 5/453 |
| 5,117,518 | 6/1992 | Schild | 5/453 |
| 5,233,974 | 8/1993 | Senoue et al. | 128/64 |
| 5,243,721 | 9/1993 | Teasdale | 5/453 |
| 5,249,318 | 10/1993 | Loadsman | 5/453 |
| 5,267,364 | 12/1993 | Volk | 5/453 |
| 5,325,551 | 7/1994 | Tappel et al. | 5/453 |
| 5,370,439 | 12/1994 | Lowe et al. . | |
| 5,375,273 | 12/1994 | Bodine, Jr. et al. | 5/715 X |
| 5,379,471 | 1/1995 | Holdredge | 5/456 |
| 5,396,671 | 3/1995 | Stacy | 5/713 X |

*Primary Examiner*—Michael F. Trettel
*Attorney, Agent, or Firm*—Malin, Haley, DiMaggio & Crosby, PA

[57] ABSTRACT

A pulsating medical (surgical) operating table cushion comprising an air sac array having two groups of pneumatically expandable and contractible air cells respectively communicating with one another in each of the groups. An air pump supplies air under pressure to the cells in each group through a separate conduit pipe for each respective group. Solenoid valves direct the air flow from the air pump either into the first conduit or the second conduit based upon an air supply controller. A timer provided in the air supply control circuitry changes the sequence of the air control valves after a predetermined period of time passes.

4 Claims, 4 Drawing Sheets

PULSATING OPERATING TABLE CUSHION

BACKGROUND OF THE INVENTION

1. Field of the Invention

The present invention relates to an air sac overlay cushion, and more particularly, to a pneumatically variable air sac overlay cushion for placement on a patient medical (surgical) operating table for the prevention of, and relief from, tissue pressure that causes decubitus ulcers during long medical operations.

2. Description of Background Information

Decubitus ulcers, which are also referred to as pressure ulcers, pressure sores, and bed sores, are a pervasive problem in the health care field. Decubitus ulcers occur when blood flow through the skin capillaries is occluded by virtue of the fact that tissue is compressed for a prolonged period by gravity and the weight of the person against a support surface. With the interruption of blood flow and, hence, oxygen supply, a sequence of intracellular events occurs which can proceed to an irreversible stage if the blood flow is not restored.

The most crucial factors in the formation of decubitus ulcers are the intensity and duration of the pressure applied to the tissue. If the patient remains immobile and in the same position for periods of time that are less than about two hours, generally no long term or irreversible damage is done to the soft tissues over bony prominences. However, if the period of immobility exceeds about two hours, decubitus ulcers begin to form. It is for this reason, in particular, that it is the policy of many hospitals and institutions to physically move and reposition patients about every two hours. However, this practice is not totally effective, nor is it always practical or possible. Patients who must undergo long surgical procedures (e.g., four to twelve hours) are especially susceptible to tissue cell damage as their physical condition and circulation are compromised. It is generally not possible to turn the patient during such operations and, in addition, the operating table surfaces are normally quite hard for patient support.

There are a variety of systems available that are intended to reduce the formation of decubitus ulcers. Most of these systems function on one of two principles: 1) static devices, e.g., foam mattresses, air mattresses, waterbeds, and sheepskins, which attempt to redistribute support away from bony prominences; and 2) active devices, e.g., alternating air mattresses, which function by alternately shifting support pressure by alternately inflating and deflating a number of inflatable cells.

Although such devices are improvements over the use of conventional mattresses, there is a need for further improvement in effectiveness and/or in efficiency of use. Furthermore, none of the devices in the prior art provide for any individualized skin pressure-sensitive support surface for a patient lying on an operating table for long periods of time to prevent decubitus ulcers or other skin diseases.

SUMMARY OF THE INVENTION

The present invention provides a pulsating pneumatic air sac overlay device for a medical operating table providing patient tissue pressure relief as the patient lies on a hard surfaced medical (surgical) table. This tissue pressure relief is accomplished by an air sac overlay that includes an array of elongated, inflatable, hollow, expandable, tubular sections that are supplied with pressurized air from an air pump unit. The array comprises a plurality of elongate, inflatable, hollow, expandable, tubular sections, each formed from nylon coated with vinyl sheeting, which is radio-frequency welded into the desired shape and configuration. The air sac array is sized in length and width to fit contiguously upon a surgical operating table. The tubular air sacs are unitarily constructed together such that they lie side-by-side or parallel to one another and extend transversely to the longitudinal direction of the operating table. The tubular sections are substantially circular in cross section when inflated, and substantially elliptical in cross section when deflated.

In use, the air sac array is housed within a protective enclosure that is removable, flexible, disposable, breathable, and forms a liquid barrier, and which is preferably made out of DuPont "TYVEX™" No. 1622E, or other equivalent material. The protective enclosure includes fasteners, preferably of the hook and loop variety, such that the four corners of the cover are held down flat to itself, preferably by the use of a suitable number of pieces of "VELCRO®". The cover provides a protection for the cushion to prevent blood and other liquids which may be prevalent during any operation from contaminating the cushion. The cover is sized to fit over the top of the cushion, and is vapor permeable (breathable) to prevent moisture buildup between the patient's skin and the fabric.

During an operation, operating room staff normally use sterile sheets when creating a sterile field in the area of the operation. When using the present invention, a sterile sheet is placed over the "TYVEX™" cover and directly under and in contact with the patient, in the area of the operation. The placement of the sterile sheet is consistent with normal operating room procedure and is not affected by the operating table cushion.

In the operating cushion of the present invention, an air sac array is formed to have at least two groups of pneumatically expandable and contractible air cells respectively communicating with each other. The cells in one of the groups are respectively disposed between adjacent ones of the cells in the other group. The respective cells in each group are coupled through a single air supply tube to an air pump. A valve, cyclically actuated, changes the pump's mode from air supplying to discharging. The valve is provided in at least one of the air supply paths which couples the air pump and the air cells in that group so as to cyclically supply and discharge air into and out of the cells.

The air cells are filled under pressure by an air pump with pressure control solenoid valves, electronic control circuitry, and at least two outlet lines mounted together in a control assembly. The air pump and control valve assembly includes an operating table mount, such as a U-shaped member, to allow the pump to be hung vertically over the rail which is attached to the operating table around all four sides. Alternately, the air pump may be hung from any "IV"-type pole with wheels to remove it from the immediate operating area.

The air pump has two outlet nozzles that connect to a first and a second inlet air conduit connected to the respective cells in each group as described above. Solenoid valves direct the air flow from the air pump, above atmospheric pressure, either into the first conduit or the second conduit, based on an electric air supply controller. A timer provided in the air supply control circuitry, which is electrically powered, changes the sequence of the air control valves after a predetermined amount of time passes, such as five minutes.

In the first five-minute time period, the first inlet air supply conduit is supplied with pressurized air that inflates every other air cell to a predetermined pressure level. Adjacent air cells are not inflated. In the second five-minute period, the alternating noninflated air cells are filled with pressurized air, while the first filled air cells lose their air pressure when the pressurized flow from the pump is switched to fill the noninflated cells.

With the apparatus of the present invention of such an arrangement, one of the valves actuated to change over to the air supplying mode causes air to be supplied from the air pump through one of the air supply tubes to the expandable and contractible air cells in one of the groups, so that cells mutually communicating will expand. When the valve is shifted to its air discharging mode, the cells will contract. In the operation of the device, the variable air pressure changes to the air sacs per-unit time can be set by control circuitry and timer circuitry in an air supply control box that is connected electrically to solenoid-actuated pneumatic valves connected to the air pump conduits.

Because the air sac overlay of the instant invention is intended to be used on a surgical operating table, it is important that the diameter of the tubular sections be as small as possible, and yet effective, so as not to cause any motion or instability from the patient lying on the tubular sections. In that regard, in the preferred embodiment, each tubular section, when inflated, is approximately 2 inches in diameter, and when deflated, is approximately 3⅛ inches in width.

If motion from the alternating inflation and deflation of the air sacs is detected, as may be the case in an operation using microscopic equipment, the controller has a "static air mode". The "static air mode" does not alternate between inflations and deflations of the air sac array but provides continuous static air. Therefore, during critical microscopic surgery, there is no movement of the air sac array. The controller can be switched back to the alternating pressure mode at any time.

The air sac overlay of the instant invention can be firmly secured to the operating table to keep the overlay in a static position, longitudinally and laterally relative to the table top surface to minimize any movement during an operation. The overlay is positioned to prevent migration by a series of securing straps, which, in the preferred embodiment, have hook and loop type fastener material disposed thereon.

In the preferred embodiment, there are four hand straps, two on each side of the cushion, which can be used by hospital staff to move the patient off the operating room table onto a gurney or bed. The patient can then continue to receive tissue pressure relief by simply unplugging the controller unit and bringing the controller unit along with the patient to the recovery room, and then plugging the controller unit in again.

It is an object of the present invention to provide a pneumatic air sac overlay for a surgical operating table which assists in the prevention of pressure sores (decubitus ulcers).

Another object of the present invention is to provide an operating table air sac overlay including a plurality of alternating inflatable sections, forming two groups of inflatable sections, wherein air pressure within each section of each group is substantially equal.

A still further object of the present invention is to provide a cushion that provides, to a patient's body, tissue pressure relief as the patient lies on a hard operating room table, wherein the pressure relief is accomplished by a series of inflatable sections that are caused to alternately inflate and deflate.

In accordance with these and other objects which will become apparent hereinafter, the instant invention will now be described with particular reference to the accompanying drawings.

DESCRIPTION OF THE PREFERRED EMBODIMENTS

Figure 1:
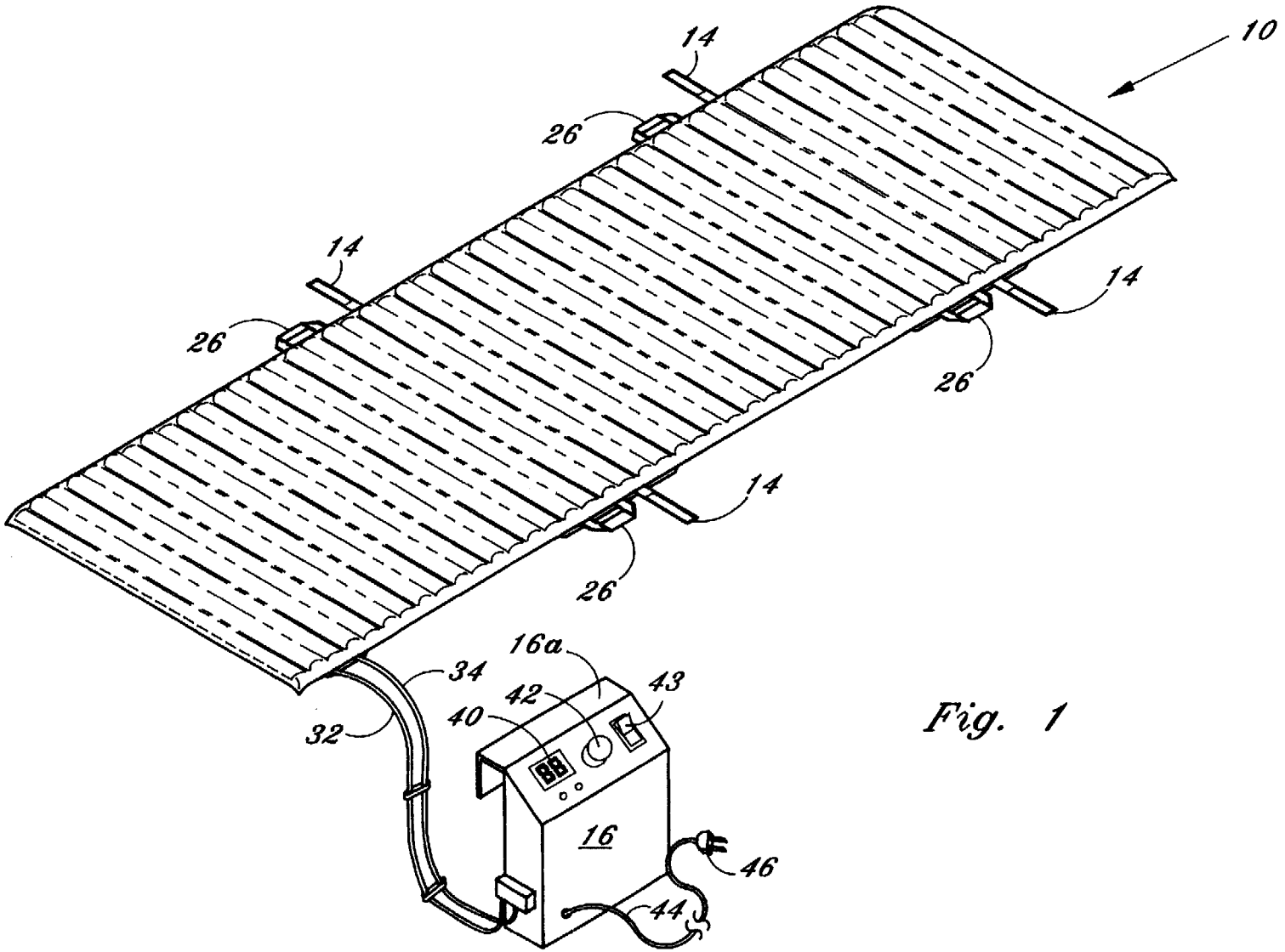
FIG. 1 is a perspective view of the operating table cushion.
Figure 2:
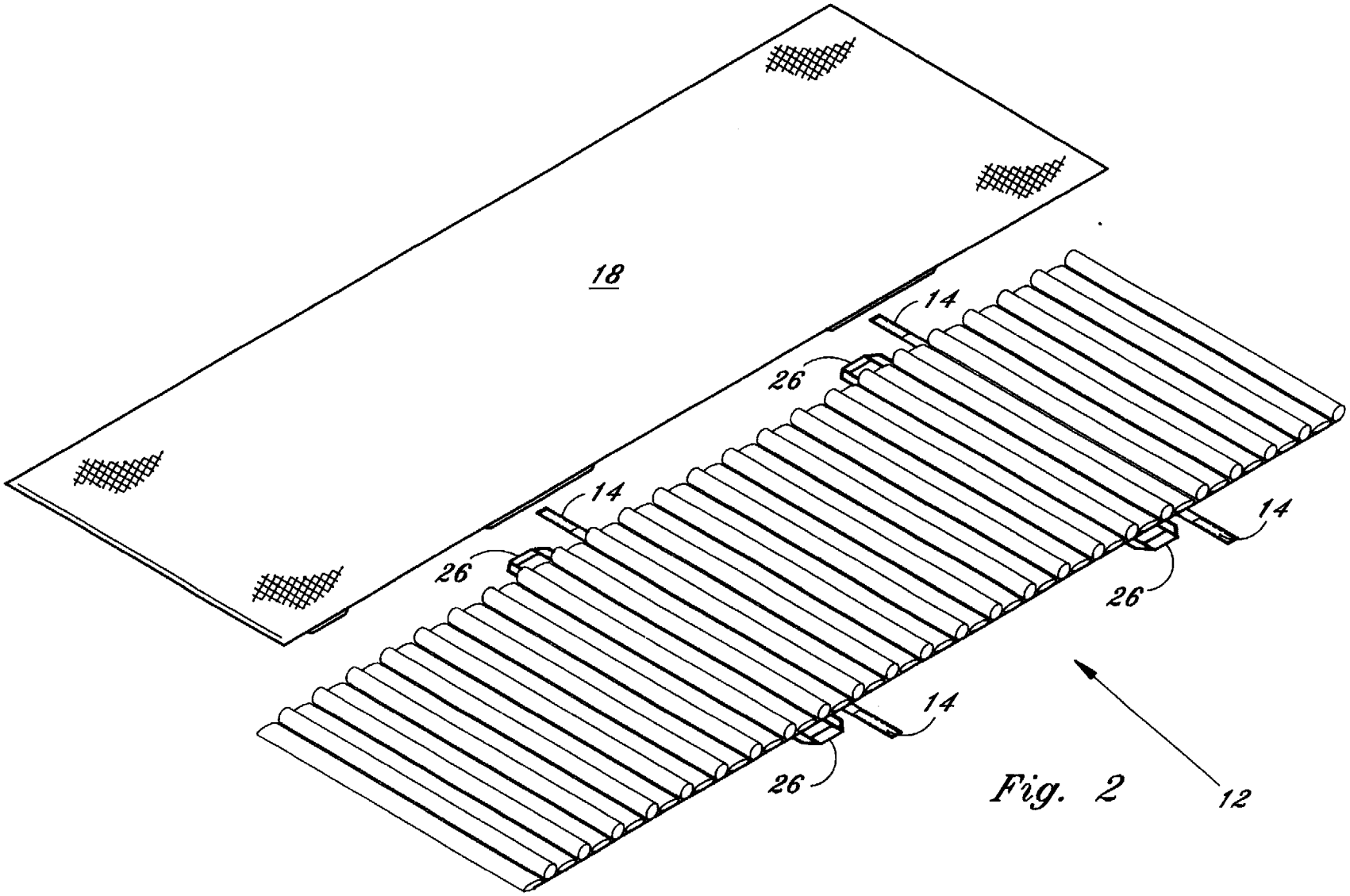
FIG. 2 is a perspective view of the top of the air sac array and the protective enclosure.

Referring now to the drawings, and in particular FIGS. 1–4, the present invention is shown generally as a pulsating medical (surgical) operating table cushion 10, shown in FIG. 1, for providing to a patient's body, tissue pressure relief as the patient lies on a hard operating table. The surgical operating table cushion 10 comprises an alternating air pressure controlled air cell array 12, shown in FIG. 2, that can be removably attached to a conventional operating table (not shown) with a plurality of straps 14 (for clarity only 4 are shown in the Figs.), a coverlet 18, shown in FIGS. 2 and 3, that can be removably attached over the exterior surface of the air cell array 12 as a liquid barrier, a portable air supply including air flow and pressure control for providing air pressure, including an air pump housed in air control supply box 16, that includes a mounting arm **16*a* which allows the entire air control supply box 16 to be mounted on the rail which is attached to the surgical operating table around all four sides (not shown). The air control components and circuits in supply box 16 are electrically powered, including the air pump maintained therein, through a cord 44 having an outlet plug 46** that plugs into a conventional AC electrical system.

Inside the air control supply box 16, shown in FIG. 1, is an electrically powered air pump, an electrical timer that connects to the air pump and to a pair of solenoid valves that are attached to the outlet side of the pump and to inlet conduits 36 and 38, (shown in FIG. 4), by hoses 32 and 34 each of which are connected to alternating side-by-side elongated air cells 22 and 24 which make up the array. The air supply box 16 includes a controller knob 42 and a power switch 43 which respectively provides for manual pressure adjustment and turning the device on and off.

The air cell array 12 comprises a plurality of elongate, inflatable, and individually pressurized air cells 22 and 24, respectively, pressure controllable through two separate inlet air conduits 36 and 38, which connect alternately to every other air cell, thereby forming two groups of pneumatically expandable and contractible air cells respectively communicating with each other. The cells in one of the groups are respectively disposed between adjacent ones of the cells in the other group. The elongated air cells 22 and 24 are formed from nylon coated with vinyl sheeting, which is radio-frequency welded into the desired shape and configuration, thereby forming a side-by-side array of air cells that are independently sealed and function independently as to the containment of air. The air cell array is sized in length and width to fit upon a surgical operating table. Each air cell 22, 24 is placed upon and connected to a bottom sheet 17 made of the same material as the individual cells. The cells 22, 24 are held in position such that they extend transversely to the longitudinal direction of the operating room table.

Figure 3:
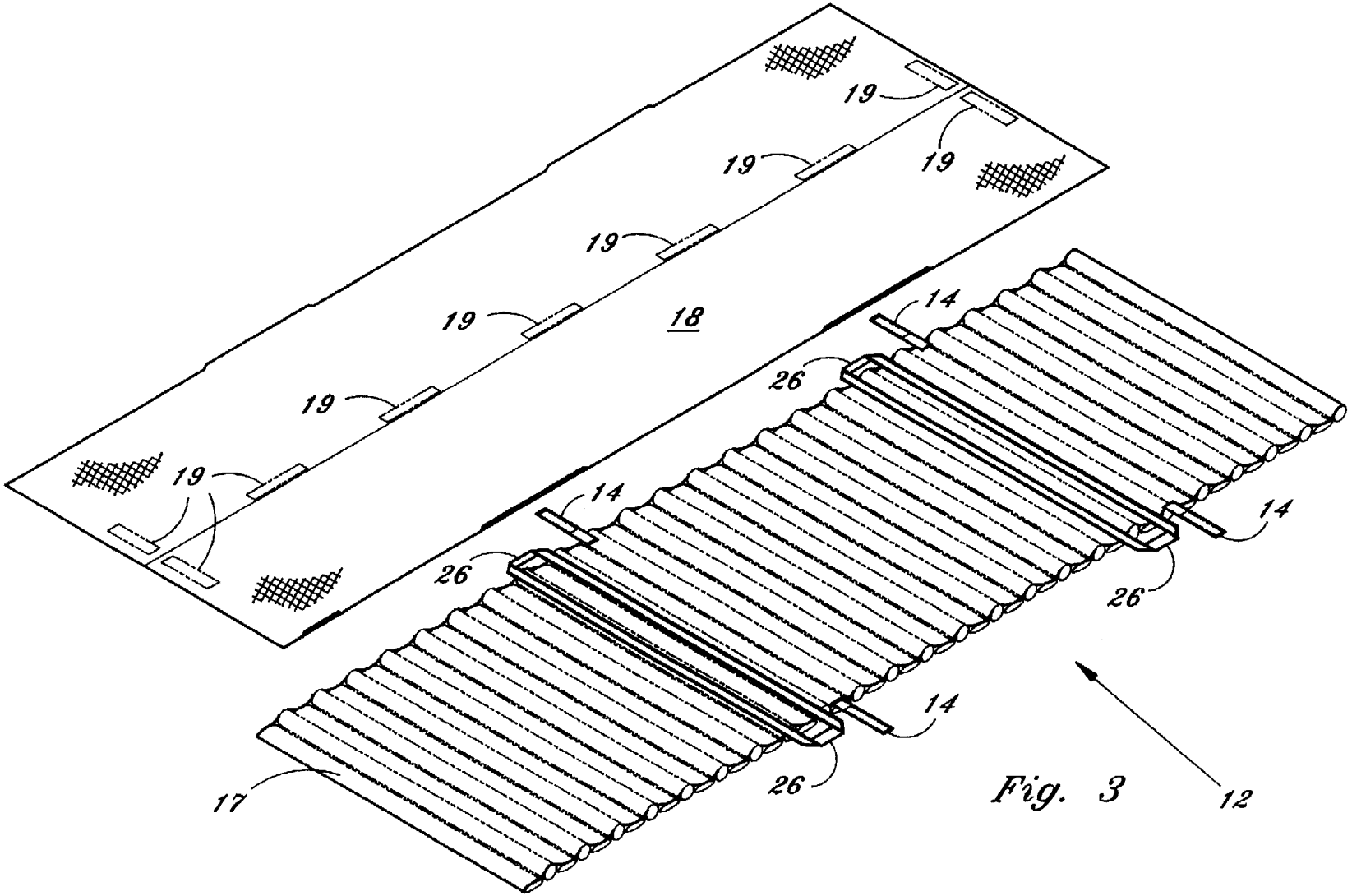
FIG. 3 is a perspective view of the bottom of the air sac array and the protective enclosure.

The bottom sheet 17 shown in FIG. 3, includes a series of securing straps 14, which, in the preferred embodiment, have hook and loop type fastener material connected thereto, which allow the array 12 to be anchored to the surgical operating table to hold the entire air cell array 12 firmly in place on the operating table. Furthermore, there are, in the preferred embodiment, four hand straps 26, two on each side of the cushion 10, which can be used by hospital staff to move the patient off the operating table onto a gurney or bed.

Figure 4:
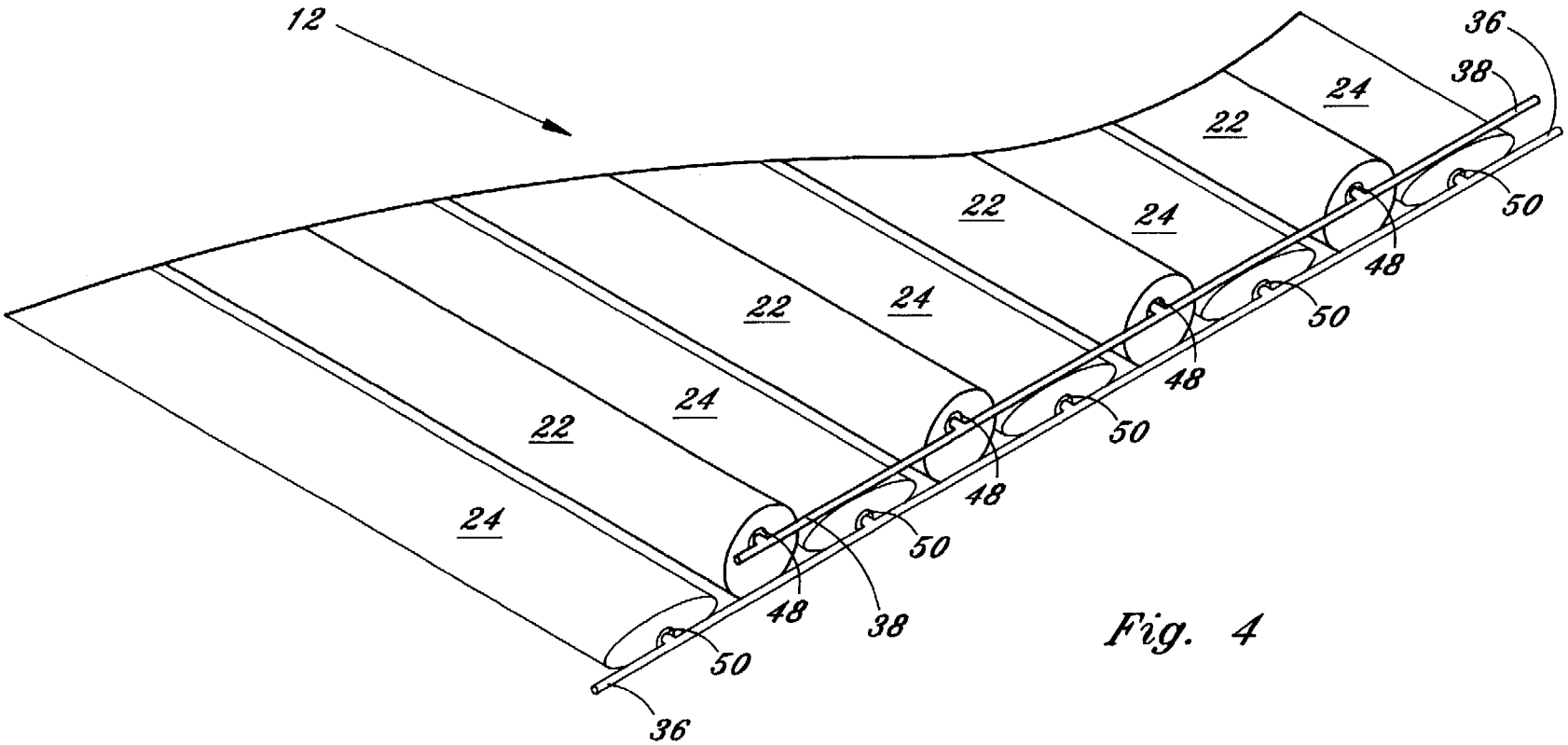
FIG. 4 is a perspective view of a portion of the individual air cells showing the air inlet conduits.

The purpose of the invention is for skin treatment and the prevention of decubitus ulcers during long operations, which is provided by alternating areas of force or pressure on the skin of the user. Specifically, an immobile patient placed on an operating table can be stimulated in different skin areas at different time periods using alternate (spaced apart) air cells such as 24 which are fully pressurized while the adjacent air cells 22 (on each opposite side) are not pressurized as shown in FIG. 4. The unpressurized air cells collapse under the weight of the patient lying on the operating table. Periodically and in accordance with a predetermined time period that can be set through the control of the air supply box 16, control knob 42 can be set for the desired pressure of the inflated set of air cells. The time period and pressure can be selectively displayed on display 40 (shown in FIG. 1). At the end of the time period, a different solenoid valve is opened, which allows air under pressure from the air supply box 16 to fully pressurize the alternate air cells to a predetermined pressure. The previously pressurized air cells, when not being pressurized, drain air back into their own supply line. By alternating air cells and the pressure contained therein, different areas of the body will be tacitly stimulated with force pushing against the body area to allow for stimulation of the skin area.

In use, the air cell array 12 is housed within a removable, disposable, flexible cover 18 (shown in FIGS. 2 and 3), which is preferably made out of DuPont "TYVEX™" No. 1622E, or other equivalent material. The cover includes fasteners 19, preferably of the hook and loop variety, such that the four corners of the cover are held down flat to itself, preferably by the use of a suitable number of pieces of "VELCRO®". The cover 18 is sized to fit over the top of the cell array 12, and is vapor permeable (breathable) to prevent moisture buildup between the patient's skin and the fabric. Operating room staff will typically place a sterile sheet (not shown) over the "TYVEX™" cover 18 and directly under and in contact with the patient, in the area of the operation. The operating table cushion does not interfere with the sterile field created by the staff.

The "TYVEX™" cover provides protection for the cell array 12 by preventing blood and other liquids, which may be prevalent during any operation, from contaminating the cell array. The "TYVEX™" cover is constructed in layered fashion having a permeable top layer covering an absorbent layer (such as in disposable baby diapers) (not shown) to absorb bodily fluids and sterilization liquids during the operation. The absorbent layer allows liquid to travel through the top layer and be absorbed, but prevents liquid from traveling back out through the top layer, thereby limiting the amount of liquid the patient might lie on during the operation. The "TYVEX™" bottom layer also prevents fluids from contaminating the cell array 12.

Referring now to FIG. 4, each of the air supply conduits 36 and 38 is attached along one side of the air cell array 12, supplying inlet air to alternating air cells 22 and 24 through inlet openings, much like a manifold, along each side. Thus, conduit 36 supplies air above atmospheric pressure to each cell in one of the two groups through an opening nozzle that is attached to each cell in that group, and conduit 38 supplies air above atmospheric pressure to each cell in the other one of the two groups through an opening nozzle that is attached to each cell in that group. When the source of pressurized air is removed, residual air in the air cell will travel back into the inlet conduit by pressure of the patient, reducing the pressure in the particular air cell.

Inlet air conduits 36 and 38 are each connected to a different air cell 22 or 24 for providing air under pressure to alternating air cells. Each air cell 22 includes an inlet conduit 48 that allows air in inlet conduit 38 to be received within the air cell 22. To provide air pressure to alternating adjacent air cells 24, inlet conduit 36 is in fluid communication with inlet conduits 50, which are sealably attached to one end of air cells 24. Thus, by providing air under pressure into conduit 36, the inflation under pressure of air cells 24 will occur. Putting air under pressure into inlet air conduit 38 will result in pressure being received in air cells 22. By selectively inflating and deflating the air cells the patient's tissue is exposed to different pressure points while lying on a hard table surface. The constant change in pressure points of the patient's tissue allows blood circulation to reach areas of the tissue that would otherwise be prevented from receiving blood flow. By allowing blood flow to reach the patient's tissues, decubitus ulcers or pressure ulcers, commonly called bed sores, are prevented.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A surgical operating table cushion for placement on a surgical operating table for reducing the formation of decubitus ulcers during long operations, comprising:

a plurality of inflatable air cells forming an air cell array, said plurality of inflatable air cells forming two groups of interconnected inflatable air cells respectively communicating with each other, the cells in one of the groups being disposed between adjacent ones of the cells in the other group, wherein air pressure within each group of air cells is substantially equal;

means for inflating and deflating each of said two groups of air cells, said means for inflating and deflating comprising:

a first conduit connected to a first one of said two groups;

a second conduit connected to a second one of said two groups;

a pump for providing pressurized air, said pump coupled to said first conduit and said second conduit;

an air inlet valve connected to said pump and said first conduit and said second conduit, said valve having at least a first operative position and a second operative position, whereby when in said first position, said valve allows pressurized air to flow only to said first conduit from said pump, and when in said second position, said valve allows pressurized air to flow only to said second conduit from said pump;

control means for controlling operation of said means for inflating and deflating, said means for controlling including a static mode wherein said plurality of inflatable air cells remain at least partially inflated for a preselected period of time to prevent movement of said surgical operating table cushion due to inflation and deflation of said inflatable air cells;

means for housing said control means and said means for inflating and deflating, said means for housing including means for removable attachment to the surgical operating table;

means for securing said cushion to said surgical operating table; and, a bottom sheet, wherein said bottom sheet and said plurality of air cells are made of the same material, each air cell being connected to said bottom sheet.

2. A surgical operating table cushion as recited in claim 1, further comprising a liquid impervious cover removably connected to said air cell array, said cover including an essentially one way vapor permeable layer covering an absorbent layer wherein a liquid passing through said permeable layer is absorbed into said absorbent layer and remains therein.

3. A surgical operating table cushion as recited in claim 1, wherein said means for securing comprises a plurality of straps connected to said bottom sheet, wherein movement of said cushion is prevented both longitudinally and laterally relative to the surgical operating table.

4. A surgical operating table cushion as recited in claim 1, further comprising a plurality of hand straps connected to said bottom sheet for moving a patient onto and off of the surgical operating table.

* * * * *